United States Patent [19]

Sarony

[11] Patent Number: 4,485,723

[45] Date of Patent: Dec. 4, 1984

[54] FIRE ARM ACCESSORY WITH RECOIL ABSORBING SECONDARY BUFFER ARRANGEMENT

[76] Inventor: Peter P. Sarony, 44 Harrowby St., London, England, W1H 5HX

[21] Appl. No.: 338,962

[22] Filed: Jan. 12, 1982

[30] Foreign Application Priority Data

Jan. 14, 1981 [GB] United Kingdom ..... 8101112

[51] Int. Cl.[3] ..... F41D 11/12

[52] U.S. Cl. ..... 89/163; 89/198

[58] Field of Search ..... 89/163, 196, 198, 199

[56] References Cited

U.S. PATENT DOCUMENTS

| | | | |
|---|---|---|---|
| 2,522,192 | 9/1950 | Porter | 89/198 |
| 3,318,192 | 5/1967 | Miller et al. | 89/199 |
| 3,731,590 | 5/1973 | Zimmerman | 89/163 |
| 4,173,169 | 11/1979 | Yates et al. . | |
| 4,201,113 | 5/1980 | Seecamp | 89/199 |

FOREIGN PATENT DOCUMENTS

| | | |
|---|---|---|
| 355644 | 8/1931 | United Kingdom . |
| 383076 | 11/1932 | United Kingdom . |
| 512228 | 8/1939 | United Kingdom . |
| 660073 | 10/1951 | United Kingdom . |
| 686628 | 1/1953 | United Kingdom . |
| 736753 | 9/1955 | United Kingdom . |
| 926777 | 5/1963 | United Kingdom . |
| 1154036 | 6/1969 | United Kingdom . |
| 1226918 | 3/1971 | United Kingdom . |
| 1386823 | 3/1975 | United Kingdom . |

OTHER PUBLICATIONS

Detonics-45 Automatic Pistol, p. 55.

*Primary Examiner*—Stephen C. Bentley

*Attorney, Agent, or Firm*—Fleit, Jacobson, Cohn & Price

[57] ABSTRACT

An accessory for a self-loading fire arm having a main recoil spring, which accessory comprises a secondary buffer arrangement for absorbing forces in the fire arm which result from firing a shot and which are not absorbed by the main recoil spring, and the secondary buffer arrangement having a guide portion for guiding the main recoil spring.

20 Claims, 6 Drawing Figures

FIRE ARM ACCESSORY WITH RECOIL ABSORBING SECONDARY BUFFER ARRANGEMENT

This invention relates to an accessory for a self-loading fire arm. This invention also relates to a self-loading fire arm when provided with the accessory.

Known self-loading fire arms have a main recoil spring. When the fire arms are employed for target shooting, the target loads are often softer than loads intended for other uses. A main recoil spring which is suitable for target loads is often too soft for other loads. Similarly, a main recoil spring which is suitable for the other loads is often too strong for target loads. When the fire arm is to be used for a different purpose, it is often necessary to change the main recoil spring and this is tedious, apart from requiring another main recoil spring.

In the known self-loading fire arms, the main recoil spring is often not guided in the fire arm. The main recoil spring may twist during use and it may cause firing inaccuracies.

It is an aim of the present invention to provide an accessory for a self-loading fire arm, which accessory obviates the need to change the main recoil spring for different target loads, and which also provides a guide for the main recoil spring.

Accordingly, this invention provides an accessory for a self-loading fire arm having a main recoil spring, which accessory comprises a secondary buffer arrangement for absorbing forces in the fire arm which result from firing a shot and which are not absorbed by the main recoil spring, and the secondary buffer arrangement having first and second parts which slide one within the other and which are of such a size that they extend firstly along substantially the entire length of a central bore of the main recoil spring and secondly across substantially the entire width of the central bore of the main recoil spring whereby the main recoil spring is guided and supported along substantially its entire length as it is compressed and expanded over the first and second parts of the accessory during use of the accessory.

Preferably, the secondary buffer arrangement comprises the first part, the second part, a secondary buffer spring housed in the second part, and a plug member, the first part sliding in the second part against the pressure of the secondary buffer spring, the plug member having a slot in it, and the plug member acting on the secondary buffer spring during use of the accessory.

Advantageously, the first part has a flat sided portion with a pair of flat sides, the flat sided portion being for passing through the plug member slot.

The accessory may include a main recoil spring, the plug member having a portion for acting against the main recoil spring.

Preferably, the accessory includes an accurising cam device, the accurising cam device having a first cammed surface for engaging with a barrel lug, a second cam surface for engaging with a barrel link member above the centre line of a barrel link member pin only when a slide stop is removed, and a guide slot for receiving the barrel link member. The accurising cam enables the barrel and the slide of the fire arm to be tightly mounted together, thereby facilitating accurate shooting. A sufficiently tight mounting is often not possible in known fire arms not having the accurising cam device and inaccurate shooting from the fire arm often results, especially when wear has occurred in the fire arm. Also, the presence of the second cammed surface enables the accessory to be easily assembled and dismantled.

Preferably, the accurising cam device has a third cammed surface for engaging with another barrel lug, the first and third cammed surfaces forming a pair of substantially identical cammed surfaces.

The present invention also provides a self-loading fire arm having the accessory of the invention.

The self-loading fire arm is preferably a pistol but, for example, the fire arm may also be a rifle. The pistols may be Government Models, 1911's, 1911 Al's, Series 70's, Gold Cup's Hardballers, other standard length Colt Type copies, Commander length pistols, together with 9 mm and .38 versions. Apart from the accessory of the present invention, the fire arms may be standard models.

An embodiment of the invention will now be described solely by way of example and with reference to the accompanying drawings in which.

Figure 1:
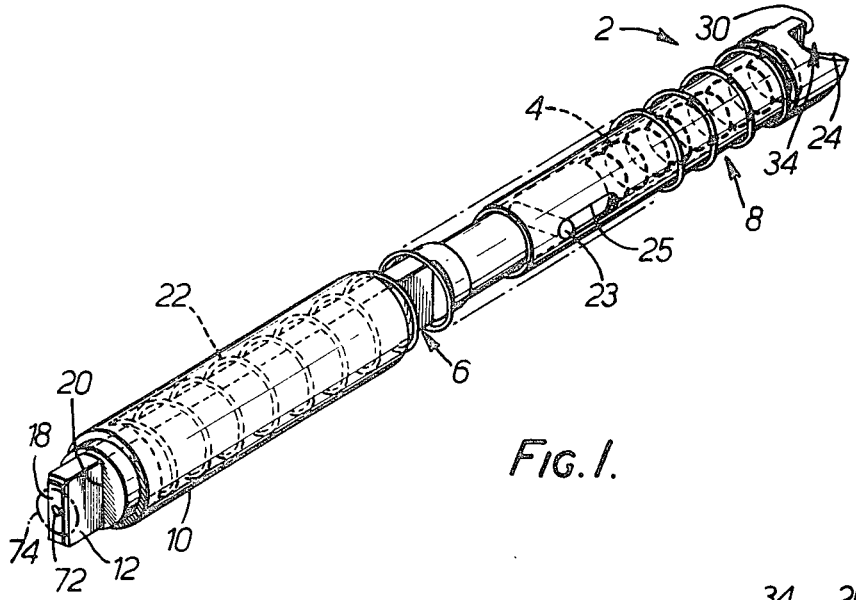
FIG. 1 is a perspective view of an accessory having a secondary buffer arrangement and an accurising cam device.
Figure 2:
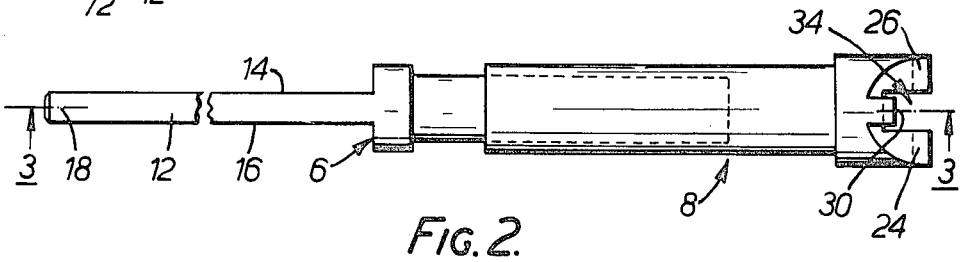
FIG. 2 is a plan view of part of the accessory shown in FIG. 1.
Figure 5:
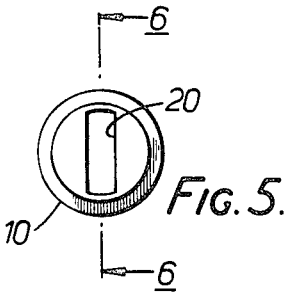
FIG. 5 is a front end elevation of a plug member forming a part of the secondary buffer arrangement shown in FIG. 1.
Figure 6:
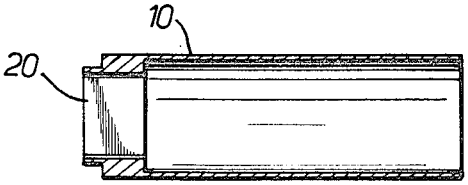
FIG. 6 is a longtudinal section on the line 6—6 shown in FIG. 5.
Figure 3:
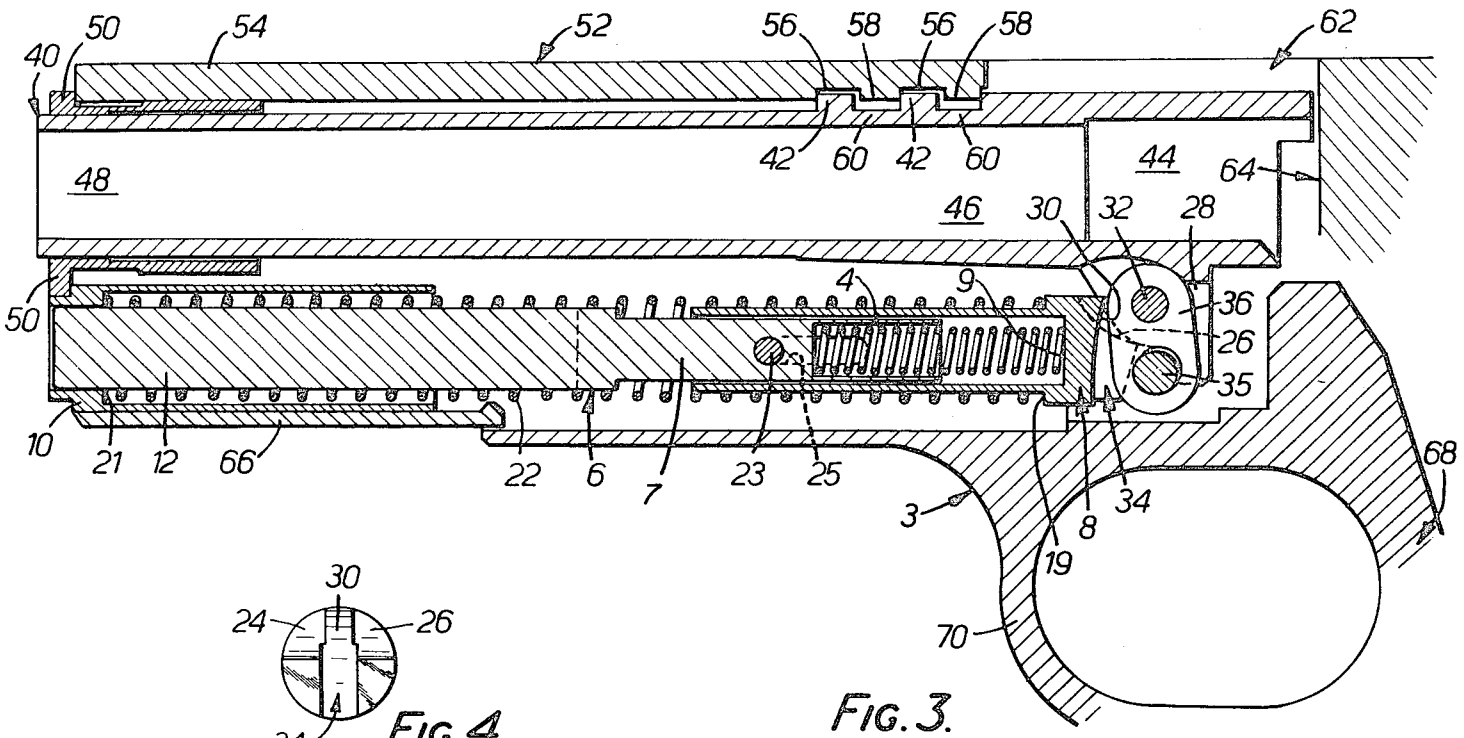
FIG. 3 is a longitudinal section on the line 3—3 shown in FIG. 2 and shows also the accessory fitted in a self-loading pistol.
Figure 4:
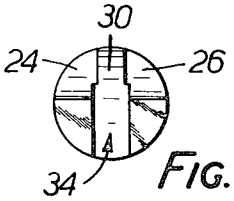
FIG. 4 is an accurising cam end elevation looking from right to left as shown in FIG. 2.

Referring to the drawings, there is shown in FIG. 1 an accessory 2 for a self-loading fire arm which is shown in FIG. 3 as a pistol 3. The accessory 2 has a secondary buffer arrangement including a secondary buffer spring 4.

The secondary buffer arrangement of the accessory 2 also comprises a first part 6 sliding in a second part 8 against the pressure of the spring 4. It can be seen that the spring 4 is housed in the second part 8 and abuts at one end against an end wall 9 of the second part 8. A plug member 10 fits over a flat sided portion 12 of the first part 6, the portion 12 having a pair of flat sides 14, 16. An end 18 of the portion 12 extends through a correspondingly shaped slot 20 in the plug member 10.

A main recoil spring 22 fits over the parts 6, 8 and is guided by these parts 6, 8. The parts 6, 8 thus form a guide portion of the secondary buffer arrangement and they guide the main recoil spring along its entire length. One end of the main recoil spring 22 abuts against a shoulder 19 on the second part 8, and the other end of the main recoil spring 22 abuts against a shoulder 21 on the plug member 10. The part 6 is retained in the part 8 by a retaining pin 23 which is a friction fit in a reduced diameter plunger portion 7 in the first part 6 and which is also centralised in position in the plunger portion 7 by the coils of the main recoil spring 22. The retaining pin 23 moves in a slot 25 in the second part 8 as the plunger portion 7 slides in and out of the second part 8 during firing of the pistol 3. During the inward sliding movement, the plunger portion 7 acts against the secondary buffer spring 4. Also during this inward movement of the plunger portion 7, the plug member 10 will act against the main recoil spring 22.

The accessory 2 has an accurising cam device formed on the right hand end of the part 8 as viewed in FIGS. 1 and 3. The accurising cam device is constituted by first and third cammed surfaces 24, 26 for engaging with a pair of barrel lugs (one of which is shown as barrel lug 28 in FIG. 3) and a second cammed surface 30 for engaging with a barrel link member 36 on a barrel link member pin 32 only when a slide stop 35 is removed. The part 8 further includes a guide slot 34 which is positioned between the first and third cammed surfaces 24, 26 and which is for receiving the barrel link member 36.

As shown in FIG. 3, the pistol 3 has a barrel 40. The barrel 40 has a pair of locking lugs 42, a barrel chamber 44, a barrel bore 46 and a muzzle end 48. A barrel bushing 50 is provided around the muzzle end 48 of the barrel 40 as shown.

FIG. 3 also shows that the pistol 3 has a slide 52 positioned around the barrel 40. The slide 52 has a forward part 54 which sandwiches the barrel bushing 50 between the muzzle end 48 and the forward part 54. The slide 52 also has a pair of locking recesses 56 for receiving the locking lugs 42 on the barrel 40, and a pair of locking lugs 58 for being received in a pair of locking recesses 60 in the barrel 40. The slide 52 further has an ejection port 62 for spent ammunition and a breech face 64. A lower front slide part forms a housing 66 for the plug member 10.

The pistol 2 which is basically of known construction except for the accessory 2 further comprises a butt or hand grip portion 68, a trigger (not shown) and a trigger guard portion 70.

The accessory 2 can be made in stainless steel or other suitable material. It can drop substantially straight into a standard pistol 3 once the old main recoil spring (and perhaps associated parts) have been removed. Gunsmithing is normally not required. Assembly and dismantling are extremely neat and simple. It is only necessary to remove the pistol stop pin and slide off the entire barrel 40 and upper receiver assembly. Re-assembly can be similarly effected in a reverse mode. The double acting spring system constituted by the main recoil spring 22 and the secondary buffer spring 4 absorbs the forces of recoil. The secondary buffer arrangement absorbs the forces via the accurising cam device 24, 26, 30. The accurising cam device acts upon the barrel lugs 28, the link member 36 and the pin 32 to form a positive barrel lock-up system. Much or all of the existing rear barrel movement in known self-loading fire arms can be obviated.

The accessory 2 can be produced to fit any Colt pattern pistol. The accessory 2 may aid faster recovery and reduce muzzle climb. It may provide a positive barrel lock-up system and it may prevent spring binding. Looseness in the barrel bushing 50 at the muzzle end 48 may be reduced, and improved feeding of round nose and wadcutter ammunition may be achieved. Full and soft loads may be employed without changing the springs 4, 22. Wear on the gun may be reduced due to the sustained use of full power loads, and this is particularly important with light alloy frames or slides. Complete removal of the main recoil spring 22 and the accessory 2 may be achieved without removing the slide 52.

The faster recovery is achieved by reducing the undesirable effects of recoil. This in turn is achieved by using the secondary buffer spring 4 and the mass of the spring guide plunger part 6, which has to move with the last part of the stroke of the slide 52 to recoil, at the same time serving to counteract the pivoting action of the slide 52 around the point at which the pistol 3 is gripped. The full length spring guide constituted by the parts 6, 8 prevents spring bind and ensures even and true in-line spring compression on every shot.

It is to be appreciated that the embodiment of the invention described above has been given by way of example only and that modifications may be effected. Thus, for example, the third cammed surface 26 could be omitted if desired. Also, the end 18 of the portion 12 can be provided with a hole 72 (see FIG. 1) for receiving a screw (not shown). The screw, can be used to attach a stop device such for example as a stop washer 74 shown in dotted lines in FIG. 1 to the end 18. It will be seen that the stop washer 74 is larger than the width of the end 18 but not larger than the length of the end 18. The end 18 and the plug member 10 can then still be compressed into the pistol 3, but the stop washer 74 prevents the main recoil spring 22 shooting the plug member 10 over the end 18 during dismantling of the pistol 2, thereby preventing the plug member 10 from being dropped or perhaps hitting the person dismantling the pistol 2.

I claim:

1. An accessory for a self-loading fire arm having a main recoil spring, said accessory comprising: a secondary buffer arrangement for absorbing forces in the fire arm resulting from firing a shot and the forces unabsorbed by the main recoil spring, and the secondary buffer arrangement having first and second parts sliding one within the other and the first and second parts are of a size extending firstly along substantially the entire length of the central bore defined by the main recoil spring and secondly the first and second parts extend across substantially the entire width of the central bore of the main recoil spring, a secondary buffer spring positioned inside the second part and the secondary buffer spring positioned inside the main recoil spring, and a plug member, the first part having a cylindrical portion slidable in the second part against the pressure of the secondary buffer spring, the first part having a flat sided portion, the first part having a collar portion separating the cylindrical portion and the flat sided portion, the collar portion being too large to slide inside the second part so that the collar portion is effective to limit the length of travel of the cylindrical portion into the second part, the plug member defining a slot, the flat sided portion projecting through the slot, and the plug member acting on the main recoil spring during use of the accessory whereby the main recoil spring is guided and supported along substantially its entire length as it is compressed and expanded over the first and second parts of the accessory during use of the accessory.

2. An accessory according to claim 1 further comprising an accurising cam device, the accurising cam device including a first cammed surface, a first barrel lug engaging the first cammed surface, a second cammed surface, a barrel link member, a barrel link member pin, a centre line defined by the barrel link member pin, a slide stop, the second cammed surface engaging the barrel link member above the centre line of the barrel link member pin only when the slide stop is removed, and a guide slot for receiving the barrel link member.

3. An accessory according to claim 2 wherein the accurising cam device has a third cammed surface, a second barrel lug engaging the third cammed surface, and the first and third cammed surfaces form a pair of substantially identical cammed surfaces.

4. A self-loading fire arm comprising: a main recoil spring and an accessory, said accessory comprises a secondary buffer arrangement for absorbing forces in the fire arm resulting from firing a shot and the forces unabsorbed by the main recoil spring, and the secondary buffer arrangement having first and second parts sliding one within the other and the first and second parts are of a size extending firstly along substantially the entire length of the central bore defined by the main recoil spring and secondly the first and second parts extend across substantially the entire width of the central bore of the main recoil spring, a secondary buffer spring positioned inside the second part and the secondary buffer spring positioned inside the main recoil spring, and a plug member, the first part having a cylindrical portion slidable in the second part against the pressure of the secondary buffer spring, the first part having a flat sided portion, the first part having a collar portion separating the cylindrical portion and the flat sided portion, the collar portion being too large to slide inside the second part so that the collar portion is effective to limit the length of travel of the cylindrical portion into the second part, the plug member defining a slot, the flat sided portion projecting through the slot, and the plug member acting on the main recoil spring during use of the accessory whereby the main recoil spring is guided and supported along substantially its entire length as it is compressed and expanded over the first and second parts of the accessory during use of the accessory.

5. A self-loading fire arm according to claim 4 further comprising an accurising cam device, the accurising cam device including a first cammed surface, a first barrel lug engaging the first cammed surface, a second cammed surface, a barrel link member, a barrel link member pin, a centre line defined by the barrel link member pin, a slide stop, the second cammed surface engaging with the barrel link member above the centre line of the barrel link member pin only when the slide stop is removed, and a guide slot for receiving the barrel link member.

6. A self-loading fire arm according to claim 5 wherein the accurising cam device has a third cammed surface, a second barrel lug engaging with the third cammed surface, and the first and third cammed surfaces form a pair of substantially identical cammed surfaces.

7. An accessory for a self-loading fire arm having a main recoil spring, said accessory comprising: a secondary buffer arrangement for absorbing forces in the fire arm resulting from firing a shot and the forces unabsorbed by the main recoil spring, and the secondary buffer arrangement having first and second parts sliding one within the other and the first and second parts are of a size extending firstly along substantially the entire length of the central bore defined by the main recoil spring and secondly across substantially the entire width of the central bore of the main recoil spring, and an accurising cammed device, the accurising cammed device including a first cammed surface, a first barrel lug engaging the first cammed surface, a second cammed surface, a barrel link member, a barrel link member pin, a centre line defined by the barrel link member pin, a slide stop, the second cammed surface engaging the barrel link member above the centre line of the barrel link member pin only when the slide stop is removed, and a guide slot receiving the barrel link member, whereby the main recoil spring is guided and supported along substantially its entire length as it is compressed and expanded over the first and second parts of the accessory during use of the accessory.

8. An accessory according to claim 7, wherein the accurising cammed device has a third cammed surface, a second barrel lug engaging the third cammed surface, and the first and the third cammed surfaces form a pair of substantially identical cam surfaces.

9. A self-loading fire arm comprising a main recoil spring and an accessory, said accessory comprises a secondary buffer arrangement for absorbing forces in the fire arm resulting from firing a shot and the forces unabsorbed by the main recoil spring, and the secondary buffer arrangement having first and second parts sliding one within the other and the first and second parts are of a size extending firstly along substantially the entire length of the central bore defined by the main recoil spring and secondly across substantially the entire width of the central bore of the main recoil spring, and an accurising cammed device, the accurising cammed device including a first cammed surface, a first barrel lug engaging the first cammed surface, a second cammed surface, a barrel link member, a barrel link member pin, a centre line defined by the barrel link member pin, a slide stop, the second cammed surface engaging wih the barrel link member above the centre line of the barrel link member pin only when the slide stop is removed, and a guide slot for receiving the barrel link member.

10. A self-loading fire arm according to claim 9, wherein the accurising cammed device has a third cammed surface, a second barrel lug engaging the third cammed surface, and the first and third cammed surfaces form a pair of substantially identical cammed surfaces.

11. An accessory for a self-loading fire arm having a main recoil spring, said accessory comprising an accurising cam device, the accurising cam device including a first cammed surface, a first barrel lug engaging the first cammed surface, a second cammed surface, a barrel link member, a barrel link member pin, a centre line defined by the barrel link member pin, a slide stop, the second cammed surface engaging the barrel link member above the centre line of the barrel link member pin only when the slide stop is removed, and a guide slot for receiving the barrel link member.

12. An accessory according to claim 11, wherein the accurising cam device has a third cammed surface, a second barrel lug engaging with the third cammed surface, and the first and third cammed surfaces form a pair of substantially identical cammed surfaces.

13. An accessory according to claim 12, further comprising a secondary buffer arrangement for absorbing forces in the fire arm resulting from firing a shot and the forces unabsorbed by the main recoil spring, and the secondary buffer arrangement having a guide portion for guiding the main recoil spring.

14. An accessory according to claim 13, wherein the secondary buffer arrangement comprises a first part, a second part, a secondary buffer spring housed in the second part, and a plug member, the first part sliding in the second part against the pressure of the secondary buffer spring, a slot defined by the plug member, and the plug member acting on the main recoil spring during use of the accessory.

15. An accessory according to claim 14, wherein the first part has a flat sided portion for passing through the slot.

16. A self-loading fire arm comprising a main recoil spring and an accessory comprising an accurising cam device, the accurising cam device including a first cammed surface, a first barrel lug, a second cammed surface, a barrel link member, a barrel link member pin, a centre line defined by the barrel link member pin, a slide stop, the second cammed surface engaging the barrel link member above the centre line of the barrel link member pin only when the slide stop is removed, and a guide slot for receiving the barrel link member.

17. A self-loading fire arm according to claim 16, wherein the accurising cam device has a third cammed surface, a second barrel lug engaging with the cammed surface, and the first and third cammed surfaces form a pair of substantially identical cammed surfaces.

18. A self-loading fire arm according to claim 17, further comprising a secondary buffer arrangement for absorbing forces in the fire arm resulting from firing a shot and the forces unabsorbed by the main recoil spring, and the secondary buffer arrangement having a guide portion for guiding the main recoil spring.

19. A self-loading fire arm according to claim 18, wherein the secondary buffer arrangement comprises a first part, a second part, a secondary buffer spring housed in the second part, and a plug member, the first part sliding in the second part against the pressure of the secondary buffer spring, a slot defined by the plug member, and the plug member acting on the main recoil spring during use of the accessory.

20. A self-loading fire arm according to claim 19, wherein the first part has a flat sided portion for passing through the slot.

* * * * *